US007384271B1

(12) United States Patent
Mickievicz

(10) Patent No.: US 7,384,271 B1
(45) Date of Patent: Jun. 10, 2008

(54) COMPRESSIVE CLOVERLEAF CONTACTOR

(75) Inventor: Scott Keith Mickievicz, Elizabethtown, PA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 11/818,322

(22) Filed: Jun. 14, 2007

(51) Int. Cl.
*H01R 12/00* (2006.01)

(52) U.S. Cl. ..... 439/66; 439/91

(58) Field of Classification Search ..... 439/66, 439/91

See application file for complete search history.

(56) References Cited

U.S. PATENT DOCUMENTS

| | | | | | |
|---|---|---|---|---|---|
| 2,124,462 | A | | 7/1938 | Challet | |
| 3,210,722 | A | | 10/1965 | Johns | |
| 3,783,433 | A | | 1/1974 | Kurtz et al. | |
| 4,973,270 | A | | 11/1990 | Billman et al. | |
| 5,030,109 | A | | 7/1991 | Dery | |
| 5,035,628 | A | | 7/1991 | Casciotti et al. | |
| 5,059,143 | A | | 10/1991 | Grabbe | |
| 5,101,553 | A | | 4/1992 | Carey | |
| 5,273,438 | A | * | 12/1993 | Bradley et al. | 439/66 |
| 5,360,347 | A | * | 11/1994 | Irlbeck et al. | 439/66 |
| 5,397,240 | A | | 3/1995 | Herard | |
| 5,540,593 | A | * | 7/1996 | Takahashi | 439/66 |
| 5,540,594 | A | * | 7/1996 | Collins et al. | 439/66 |
| 5,573,435 | A | | 11/1996 | Grabbe et al. | |
| 5,588,845 | A | * | 12/1996 | Naitoh et al. | 439/66 |
| 5,588,846 | A | * | 12/1996 | Irlbeck et al. | 439/66 |
| 5,632,626 | A | * | 5/1997 | Collins et al. | 439/66 |
| 5,636,996 | A | * | 6/1997 | Johnson et al. | 439/66 |
| 5,973,394 | A | | 10/1999 | Slocum et al. | |
| 6,313,523 | B1 | | 11/2001 | Morris et al. | |
| 6,328,573 | B1 | * | 12/2001 | Sakata et al. | 439/66 |
| 6,439,894 | B1 | * | 8/2002 | Li | 439/66 |
| 6,666,690 | B2 | | 12/2003 | Ishizuka et al. | |
| 6,722,893 | B2 | | 4/2004 | Li et al. | |
| 6,958,616 | B1 | * | 10/2005 | Mahoney et al. | 324/754 |
| 6,981,879 | B2 | * | 1/2006 | Kuczynski et al. | 439/66 |
| 7,008,275 | B2 | * | 3/2006 | Hayami et al. | 439/886 |
| 7,014,479 | B2 | * | 3/2006 | Li | 439/86 |
| 7,021,942 | B2 | | 4/2006 | Grant et al. | |
| 7,040,902 | B2 | * | 5/2006 | Li | 439/66 |
| 7,074,096 | B2 | | 7/2006 | Copper et al. | |
| 7,252,515 | B2 | * | 8/2007 | Brodsky et al. | 439/66 |
| 2001/0016433 | A1 | | 8/2001 | Pieper | |
| 2002/0102868 | A1 | * | 8/2002 | Li | 439/66 |
| 2003/0040201 | A1 | * | 2/2003 | Ishizuka et al. | 439/66 |
| 2004/0002234 | A1 | | 1/2004 | Masao et al. | |
| 2004/0132320 | A1 | * | 7/2004 | Dittmann | 439/66 |
| 2005/0202691 | A1 | * | 9/2005 | Tai et al. | 439/66 |
| 2005/0208785 | A1 | * | 9/2005 | Kuczynski et al. | 439/66 |
| 2006/0172564 | A1 | * | 8/2006 | Nilsson et al. | 439/66 |
| 2007/0049063 | A1 | * | 3/2007 | Endo | 439/66 |
| 2007/0054511 | A1 | * | 3/2007 | Ittel | 439/66 |
| 2007/0111558 | A1 | * | 5/2007 | Brodsky et al. | 439/66 |
| 2008/0003844 | A1 | * | 1/2008 | Polnyi | 439/66 |

* cited by examiner

*Primary Examiner*—Ross N Gushi
(74) *Attorney, Agent, or Firm*—Peter Van Winkle

(57) ABSTRACT

A wire (12) is bent into a row of contactors (14) that are each of miniature cloverleaf shape with each cloverleaf having a plurality of loops (21-24), the cloverleafs are then cut apart at cuts (40) to electrically isolate them from each other, and the middles of the cloverleafs are embedded into a block (43) of polymer. The combination of a row of cloverleafs and the block, are placed between upper and lower groups of terminals (30, 32) and compressed between them, to connect each upper terminal to a lower one.

13 Claims, 2 Drawing Sheets

COMPRESSIVE CLOVERLEAF CONTACTOR

BACKGROUND OF THE INVENTION

Two electronic devices with multiple closely-spaced miniature terminals often must be connected. One example is a component such as a cell phone with component terminals spaced at a pitch of one millimeter or less and a circuit board with board terminals at a corresponding spacing. A contactor assembly that engages the terminals of the two devices to connect them should have contactors that are each resiliently compressible to assure that all terminals are firmly engaged with corresponding contactors for low resistance connections. A miniature contactor assembly that could be constructed at low cost and assured good contact with each of a plurality of pairs of closely spaced terminals, would be of value.

SUMMARY OF THE INVENTION

In accordance with one embodiment of the present invention, a miniature contactor assembly is provided which can reliably connect two rows of closely spaced terminals. The contactor assembly includes a wire bent into a row of contactors, with each contactor having at least three loops that lie one slightly behind another, but with all lying in primarily the same plane. The contactors are electrically separated by cutting the wire between adjacent contactors. The contactors are held together by a holder formed by a block of insulative polymer. The polymer block can be of elastomeric material so the wire portions within the block can bend, or the polymer block can be of rigid material with grooves near the surface to accommodate more bending.

In one contactor assembly, the contactors each have four 360° loops that each extends away from the contactor axis. The loops lie one slightly behind the other, but with the distance between the frontmost loop of the contactor and rearmost loop of the contactor being less than half, and usually less than one-quarter the height of the contactor.

The novel features of the invention are set forth with particularity in the appended claims. The invention will be best understood from the following description when read in conjunction with the accompanying drawings.

DESCRIPTION OF THE PREFERRED EMBODIMENT

Figure 1:
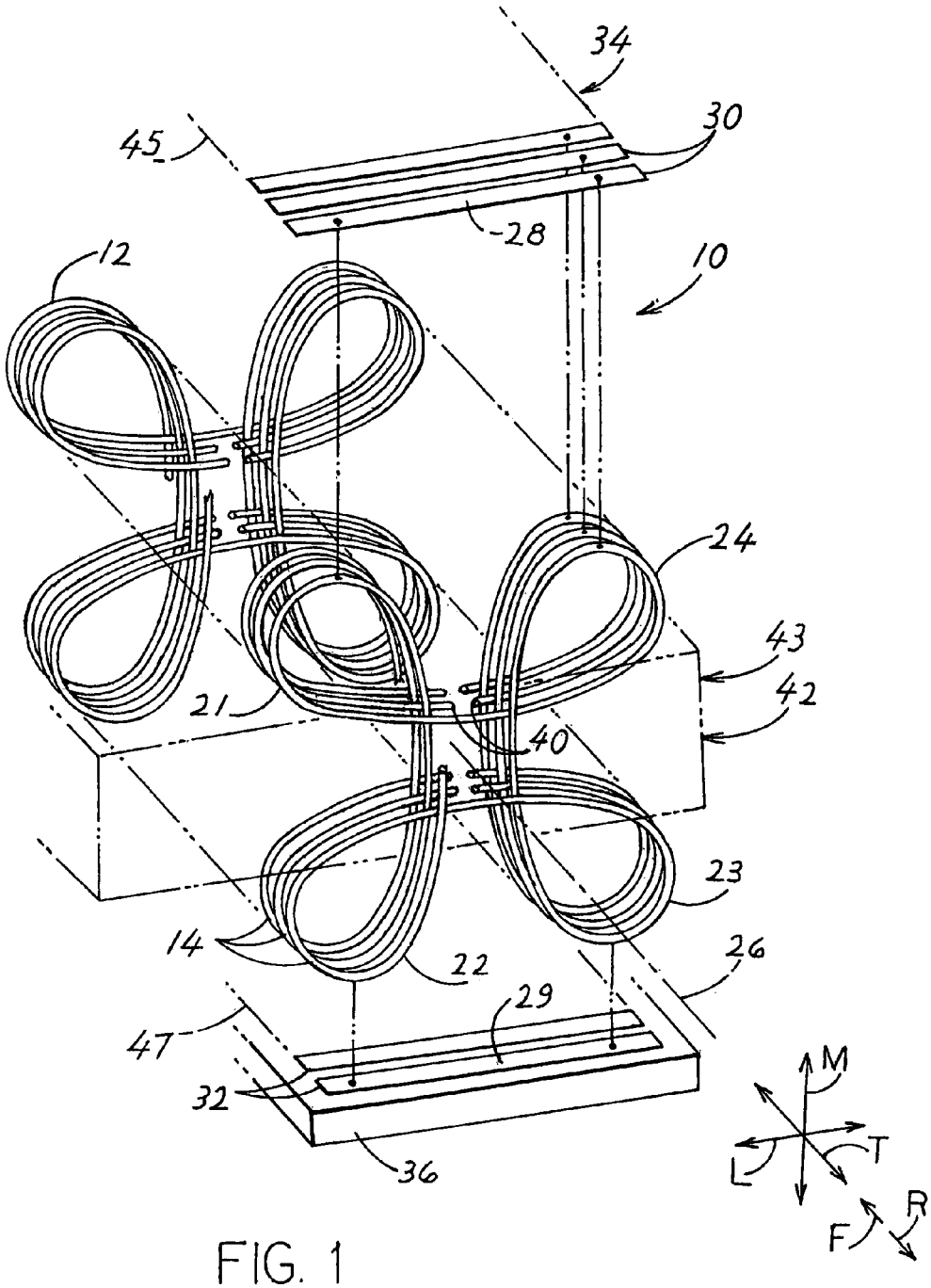
FIG. 1 is an exploded isometric view of a combination of a contactor assembly of the invention, and two rows of terminals.

FIG. 1 illustrates a contactor assembly 10 of the invention which includes a wire 12 that has been wound into a plurality of contactors 14 that lie in a row that extends along a horizontal front-rear F-R, or transverse direction T. Each of the contactors has four resilient wire loops 21-24 with loop axes angularly spaced about an axis 26. The contactors are useful to connect mating surfaces 28, 29 of two rows of terminals 30, 32 of electronic devices 34, 36. For example device 34 may be a piece of electronic equipment while the device 36 is a circuit board. The particular contactor assembly 10 illustrated includes twenty-one contactors. The contactors were originally wound from a single wire, and are electrically separated by cuts at 40 that remove short lengths of the wire. A holder 42 formed by a block 43 of insulative polymer material that has been molded around the row of contactors, holds the contactors spaced apart. The horizontal planes 45, 47 of the two groups of terminals 30, 32 are perpendicular to longitudinal directions M.

Figure 3:
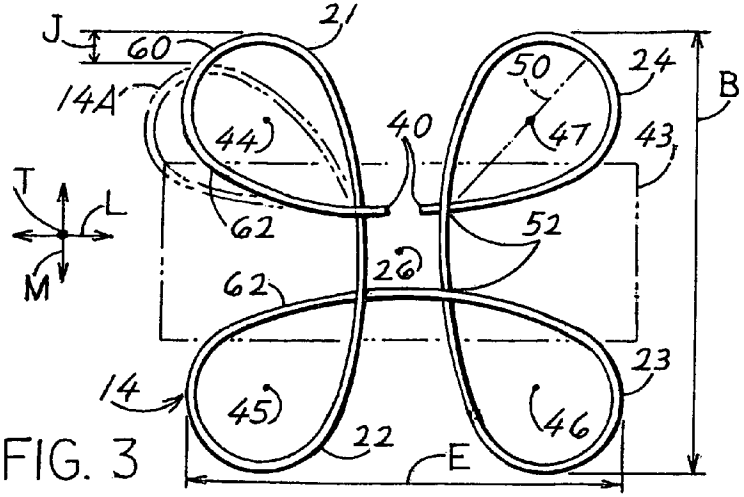
FIG. 3 is a front elevation view of one of the contactors of FIG. 1, and showing in phantom lines a portion of the contactor after it has been compressed.

FIG. 3 shows one contactor 14 in the form of wire wound into four loops 21-24. Each loop has a transversely-extending axis 44-47. Each loop is a closed loop even though the wire does not connect at the loop inner ends 52. The location of each axis is at the center of the area of the loop. Each loop is symmetric about a line 50 that passes though the axis and though the inner end 52 of the loop. Each loop inner end is the end closest to the opposite loop and to the contactor axis 26. Each loop extends 360° about the corresponding axis. The upper pair of loops 21, 24 are laterally L spaced, and the lower pair of loops 22, 23 are laterally L spaced. The upper and lower loops are vertically, or longitudinally M spaced.

Figure 2:
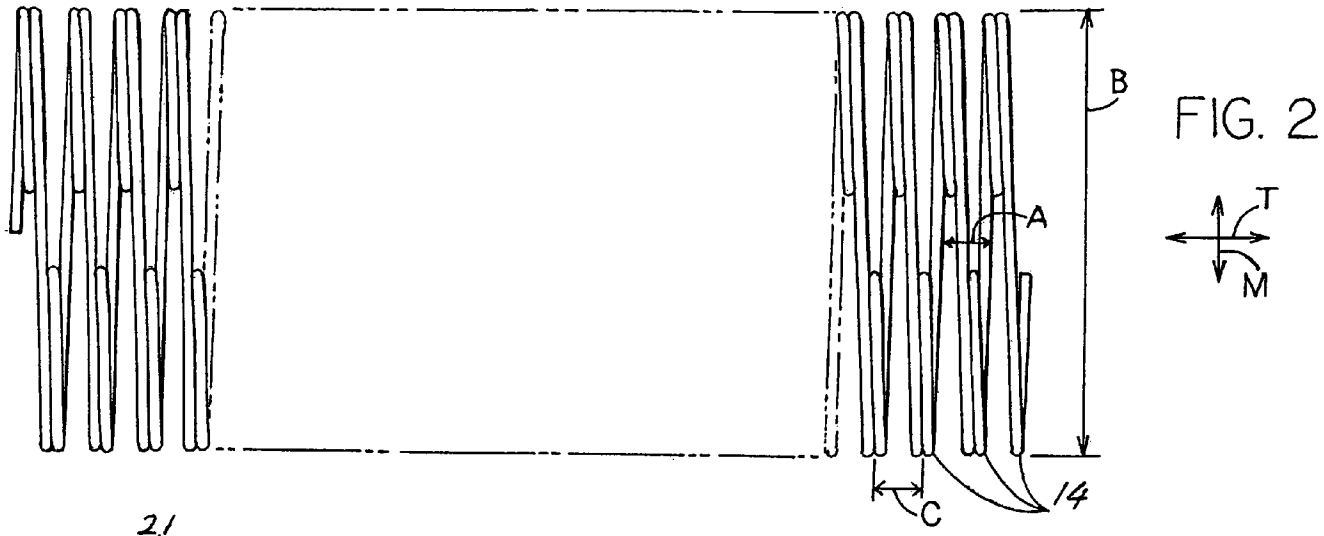
FIG. 2 is a side elevation view of the row of contactors of the contactor assembly of FIG. 1.

In FIG. 3 the loops lie one behind another in the front-to-rear, or transverse direction T, with loop 21 frontmost, loop 22 lying rearward of loop 21, loop 23 lying rearward of loop 22, and loop 24 lying at the rear of the contactor. FIG. 2 shows that the loops lie closely behind one another. The contactor lies primarily in a plane, in that the transverse depth A of the four loops of each contactor is less than one half, and preferably less than one-fourth, the longitudinal length or height B of the uncompressed contactors. Also, the lateral length (E, FIG. 3) of the contactor is more than twice and preferably more than four times the transverse depth B. In FIG. 3, the height B is about eight times the depth A. This allows the contactors to be closely spaced, so the terminals of the electronic devices can be closely spaced. The close spacing allows small electronic devices, such as cell phones, to use the contactors. The primarily vertical plane of each contactor is normal to the transverse direction T.

The contactors are especially useful to fit in a small space and connect miniature terminals. In a combination of a contactor assembly and devices with terminals that applicant has designed, the contactor 14 of FIG. 3 had a height B of 2.5 millimeters and the contactors of the row were located at a pitch C (FIG. 2) of about 0.3 millimeter. The particular contactor assembly illustrated, which has twenty-one contactors, therefore has a transverse length of only 6.3 millimeters.

FIG. 3 shows, in phantom lines, the contactor at 14A after it has been depressed by being compressed between the rows of terminals of two electronic devices. The contactor has been compressed by a height 2J of about 0.25 millimeters. During the compression, the outer end 60 of each loop moves away from the axis 26 as the loop elongates. To allow such elongation, applicant can form the block 43 of the holder of elastomeric material. An elastomeric material is a material that has a Young's modulus of elasticity of no more than 50,000 psi. It is also possible to form the block of a rigid polymer. If the block is formed of a rigid polymer, it can be formed with grooves, indicated at 64 in FIG. 4, to receive wire portions near the surfaces of the block that are deflected in the block.

It is possible to connect two rows of terminals using a wire wound into only one loop, with the loop top and bottom contacting opposite terminals. It is also possible to connect two rows of terminals using a wire bent into only one top loop and one bottom loop. However, if one of such loops of a row of them is mounted so it is tilted considerably, then such tilted loop may not engage the corresponding terminal. Applicant's use of two loops at the top and bottom of the contactor, results in two widely spaced loops being compressed by a terminal. If a contactor is tilted, one of its two loops will be compressed a lot and the other will be compressed little or not at all, and at least one of the two loops will contact the corresponding terminal.

The use of at least two loops projecting from one of the faces of the block also helps in the manufacture of the contactor assembly. The contactors can be cut apart and laid on a surface of a jig, with the two lowermost loops helping to assure proper orientation of the contactors until the holder block is molded around the middles of the contactors.

Figure 4:
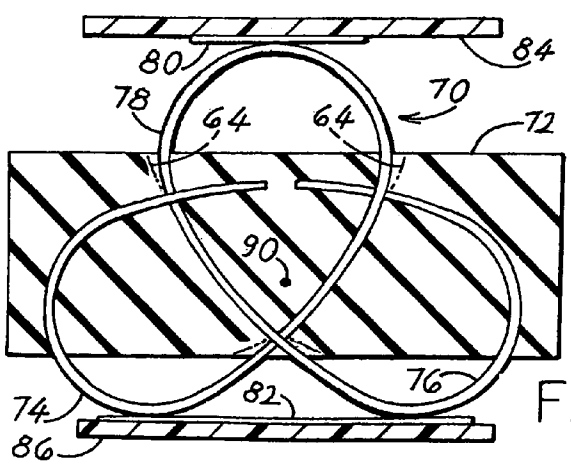
FIG. 4 is a sectional view of a combination of a contactor of another embodiment of the invention that has three loops, and a pair of terminal devices that engage the contactor.

FIG. 4 is a front view of a contactor 70 of another embodiment of the invention, shown mounted in an insulative holder 72 in the form of a block. The contactor 70 has three loops, including two lower loops 74, 76 and one upper loop 78. The upper loop 78 does not provide the degree of stability as two upper loops, but the two lower loops properly orient the contactor during manufacture, so the finished assembly will properly contact upper and lower terminals 80, 82 of the two electronic devices 84, 86. The outer ends of the three loops are equally spaced from a transverse axis 90.

Although terms such as "vertical", "top" and "bottom" are used herein to describe parts as illustrated, it should be noted that the contactor assembly can be used in any orientation.

Thus, the invention provides a miniature contactor assembly for connecting two rows of terminals, which can be made at low cost and can connect together terminals that are very closely spaced. A row of contactors is formed from a single wire that is wound into a set of least three loops for each contactor, with the sets of loops electrically separated by cutting the wound wire or cutting away a length of the wire between each set of loops. The loops are held in the proper orientations and at the desired spacing, by a holder block of insulative (polymer) material. At least two loops project from one of the faces of the holder block, to help orient the contactors during manufacture. In a preferred contactor assembly, each contactor has four loops that each has an inner end that is spaced form the axis of the contactor.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A contactor assembly comprising:

a wire wound into a transversely-extending row of contactors, each contactor including a plurality of loops that each extends 360° about a horizontal transverse axis, with the loops of each contactor all lying in primarily the same vertical plane with their transverse axes being parallel but spaced apart, and with said wire cut between adjacent contactors to electrically isolate them from each other.

2. The assembly described in claim 1 including:

a holder that comprises a block of dielectric polymer material having top and bottom surfaces, with portions of each of said contactors embedded in the block but with portions of said loops extending beyond said top and bottom surfaces.

3. The assembly described in claim 2 wherein:

said holder is formed of elastomeric material.

4. The assembly described in claim 2 wherein:

said holder is a molded block of rigid polymer material that has grooves that allow wire portions near the surface of the block to deflect in the block.

5. The assembly described in claim 1 including:

top and bottom terminal groups that each includes a plurality of transversely spaced terminals;

said contactors lie vertically compressed between terminals of said top and bottom terminal groups.

6. A contactor assembly for electrically connecting together each of a plurality of transversely-spaced first terminals to each of a plurality of transversely-spaced second terminals wherein said first terminals have mating surfaces lying primarily in a first plane and said second terminals have mating surfaces lying primarily in a second plane that is parallel to and spaced from said first plane, said first and second planes each being normal to a longitudinal direction, wherein lateral and transverse directions are perpendicular to each other and to said longitudinal direction, comprising:

a plurality of contactors each contactor comprises a wire bent into at least three loops lying primarily in a common plane and connected together by said wire and that each has a transverse axis, each loop being a closed loop as viewed along said transverse axes; and a holder that holds said plurality of contactors in a row along a transverse direction.

7. The contactor assembly described in claim 6, wherein:

said first and second pluralities of terminals lie against and compress said contactors, with at least a first of said loops of each of said contactors lying against each of said first terminals, and with at least second and third of said loops of each of said contactors lying substantially against each of said second terminals.

8. The contactor assembly described in claim 6, wherein:

said wire is bent into four loops for each contactor, all loops of a contactor lying in primarily a common plane, with two of said loops of a contactor lying adjacent to one of said first terminals and with two of said loops of a contactor lying adjacent to one of said second terminals.

9. The contactor described in claim 6 wherein:

said holder comprises a block of a polymer material having first and second longitudinally spaced opposite faces, with at least one of said loops projecting from said first face and at least two of said loops projecting from said second face.

10. The contactor described in claim 9, wherein:

said block of polymer material is an elastomeric material.

11. A combination comprising top and bottom terminal groups that each includes a transversely extending row of terminals, said terminals of said top group facing downward and said terminals of said bottom group facing upward, said combination including a transversely-extending row of electrically isolated contactors lying between said terminal groups to electrically connect selected terminals of said top and bottom groups, wherein:

each contactor includes a wire wound into four loops that each has a transverse loop axis, including a pair of laterally-spaced upper loops and a pair of laterally-spaced lower loops, all loops of a contactor connected together by the wire; and a holder comprising a quantity of polymer that surrounds lower portions of said upper loops and upper portions of said lower loops.

12. The combination described in claim 11 wherein:

said row of contactors are formed from a single wire that is wound into multiple contactors that lie one behind the previous one along said transverse direction, with the multiple contactors electrically separated by cutting the wire between adjacent contactors.

13. The combination described in claim 11, wherein:

said holder material is elastomeric.

* * * * *